United States Patent [19]

Kenk et al.

[11] 4,059,132

[45] Nov. 22, 1977

[54] BOBBIN RETAINER ON A SHUTTLE

[75] Inventors: Theodor Kenk, Karlsruhe; Erhard Kenk, Vaihingen, both of Germany

[73] Assignee: Leder & Co., AG, Kt. St. Gallen, Switzerland

[21] Appl. No.: 687,030

[22] Filed: May 17, 1976

[30] Foreign Application Priority Data

May 17, 1975 Germany ..... 2522146
Feb. 4, 1976 Germany ..... 2604153

[51] Int. Cl.[2] ..... D03J 5/16
[52] U.S. Cl. ..... 139/207
[58] Field of Search ..... 139/206–208

[56] References Cited

U.S. PATENT DOCUMENTS

| | | | |
|---|---|---|---|
| 907,476 | 12/1908 | Draper | 139/207 |
| 2,768,650 | 10/1956 | Viscolosi | 139/207 |
| 3,316,942 | 5/1967 | Thatcher | 139/207 |
| 3,853,154 | 12/1974 | Meier | 139/207 |

FOREIGN PATENT DOCUMENTS

| | | | |
|---|---|---|---|
| 375,679 | 4/1964 | Switzerland | 139/207 |

*Primary Examiner*—James Kee Chi
*Attorney, Agent, or Firm*—William Anthony Drucker

[57] ABSTRACT

An automatic weaving shuttle is provided with a recess for receiving a bobbin having cylindrical bobbin heads. To retain the bobbin head an insert is held in force engagement within said recess, said insert being formed in a substantially U-shaped configuration with two legs conjoined by a cross-piece. Within the legs are formed pairs of sliding guides disposed respectively on each side of the longitudinal central plane of the bobbin. Spring loaded dogs are slidable within said guides and engage the cylindrical surface of the bobbin head. The bobbin is centralized by a spigot engaging within a correspondingly shaped recess in the end of the bobbin head.

5 Claims, 4 Drawing Figures

Fig.1
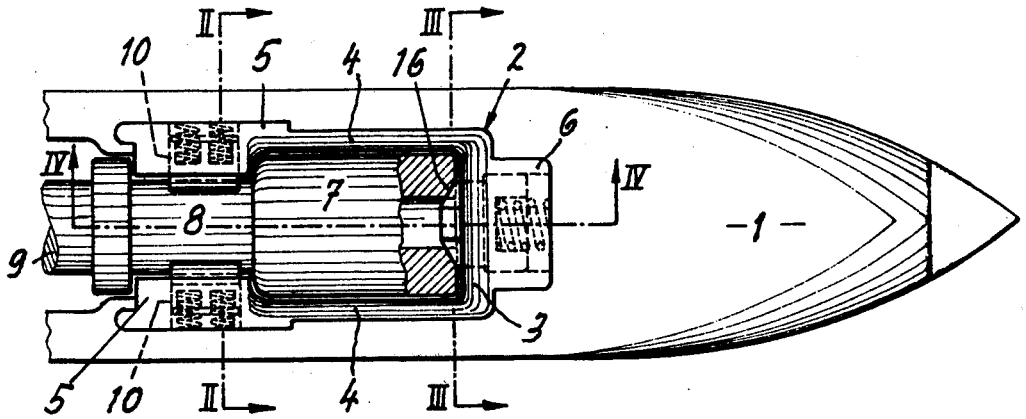
Fig.2
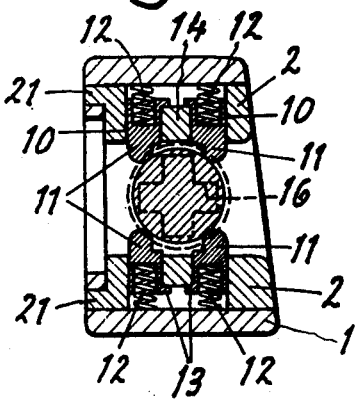
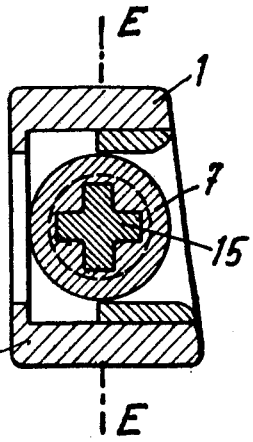
Fig.3
Fig.4
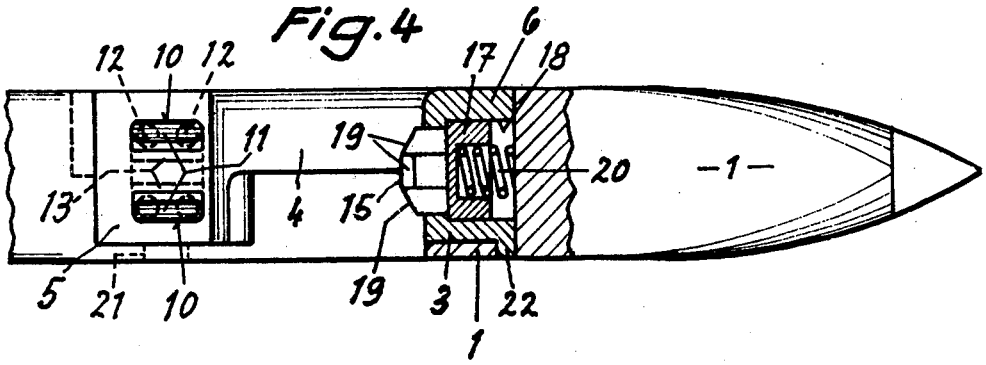

BOBBIN RETAINER ON A SHUTTLE

BACKGROUND TO THE INVENTION

The present invention relates to a bobbin retainer for automatic weaving shuttles, especially for cylindrical bobbin heads.

In known bobbin retainers of this kind the bobbin-retaining dogs are made in one piece by pairs. In the driving in and out of the weft bobbin in this case, only one dog of each pair of dogs is always pressed back into the sliding guide. This pressed back dog then carries out a pivoting movement the pivot axis of which coincides with the dog situated in the rest position. In order that such a pivoting movement may be carried out, a certain play must be present between the bobbin-retaining dogs and their guides, so that the precise central seating of the bobbin is not guaranteed. Moreover the production of such doyble dogs and of the sliding guides is very labour-expensive. For the construction of the double dogs only a thin-walled sheet steel can be used, which is subject to the danger of deformation in the driving of the bobbin into and out of the bobbin retainer.

OBJECT OF THE INVENTION

It is an object of the invention to provide a bobbin retainer which does not possess the mentioned disadvantages and which guarantees a satisfactory central seating of the weft bobbin.

SUMMARY OF THE INVENTION

According to the invention with each bobbin-retaining dog there is associated its own sliding guide, which guides are cut out by pairs in the legs of the insert on both sides of the bobbin central plane passing through between them, and in which guides the bobbin-retaining dogs are fitted mutually independently with slide fit, while additional means for the shape-locking retention and centring of the rear bobbin head end is arranged on the cross piece interconnecting the two legs of the insert. Such an additional means can be a spring-loaded coupling piece axially displaceably mounted in the cross piece of the insert and formed for shape-locking central grasping over the bobbin head or engagement in the bobbin head.

BRIEF DESCRIPTION OF DRAWINGS

A form of embodiment of the object of the invention is illustrated by way of example in the drawing, wherein:

FIG. 1 shows a plan view of a part of the shuttle with the built-in bobbin retainer and the weft bobbin inserted therein, the latter partially in axial section, FIG. 2 shows a cross-section along the line II—II in FIG. 1, FIG. 3 shows a cross-section along the line III—III in FIG. 1, and FIG. 4 shows a longitudinal section through the shuttle along the line IV—IV in FIG. 1, with weft bobbin removed.

DESCRIPTION OF PREFERRED EMBODIMENT

In the example as illustrated, 1 designates the shuttle body with the insert 2 of thermoplastic synthetic plastics material installed into a recess of the shuttle in shape-locking and forceengaging manner. This insert formed according to a U in basic form consists essentially of two legs 4 mutually interconnected by a cross piece 3, the ends of which legs terminate each in a thickening 5, while the cross piece 3 is likewise provided with a thickening 6 in its middle region. 7 designates the cylindrical head, 8 the neck and 9 the stem of the weft bobbin.

In the region of the bobbin neck 8, two elongated holes 10 (FIG. 4) serving as sliding guides are cut in the thickened part 5 of each leg 4, and in fact these holes are arranged in each case by pairs on the two sides of the central plane E—E of the bobbin (FIG. 3). These sliding guides serve for the reception each of a bobbin-retainer dog 11 consisting of tough synthetic plastics material and displaceable in the guides, which dogs are held abutting on the bobbin neck 8 under pressure by means of helical springs 12. The helical springs 12 are inserted by pairs into bores of the bobbin-retaining dogs 11 and bear on the shuttle body 1 with the ends remote from the dogs. For the limitation of stroke of the bobbin-retaining dogs 11, stops 13 are provided on them which come to abut each on a material web 14 of the insert 2 serving as abutment, when the weft bobbin is removed.

In the thickening 6 of the cross piece 3 a coupling piece (Spigot) 15, 17 intended for engagement in the rear end of the bobbin head is axially displaceably mounted. This coupling piece is formed as a cross in its forward part 15 and penetrates the cross piece 3 in a corresponding cruciform piercing, the part of this engaging cross which protrudes beyond the cross piece 3 engaging in shape-locking manner in a matching cruciform recess 16 on the rear end of the bobbin head 7. The rear part 17 of the coupling piece, which is widened in diameter in comparison with the engaging cross 15, is made cylindrical and displaceably mounted in a bore 18 of the thickening 6. As may be seen from FIG. 4, the arms of the engaging cross 15 are provided each with a bevel 19 at the protruding ends. A helical spring 20, which is retained in a bore of the cylindrical part 17 of the coupling piece and supported at the other end on the shuttle body 1, endeavours to hold the engaging cross 15 in engagement with the bobbin head 7. The bevels 19 are provided so that in the driving in and out of the weft bobbin the coupling piece can recede against the action of the spring 20.

Both the bobbin-retaining dogs 11 and the coupling piece 15 are seated with slide fit, that is practically without play, in their guides so that a precise central seating of the weft bobbin is guaranteed.

For the shape-locking connection of the insert 2 with the shuttle body 1 there serve anchoring pegs 21 (FIG. 2) and 22 (FIG. 4) protruding from the cross piece 3 or its thickening 6 and from the thickened leg ends 5, which pegs engage and are welded in matching externally accessible piercings of the shuttle body 1.

In departure from the example as illustrated and described it is naturally possible equally to arrange bobbin-retaining dogs in the region of the bobbin head 7, in which case then the wall thickness of the legs 4 would have to be increased accordingly. The use of weft bobbins with steel ring heads is also possible. In this case the bobbin-retaining dogs must be provided with corresponding channels in the region of the bobbin head and the steel rings placed thereon, in which case the bobbin-retaining dogs can also consist each of several parts, its own spring being associated with each of these parts, which has the advantage that the individual bobbin-retaining dogs can adapt themselves to any irregularities of the ring diameters.

It is also possible furthermore to make the forward part 15 of the coupling piece other than cruciform, for example square, rectangular, oval or circular in cross section. In all these cases naturally the corresponding recess in the bobbin head must also be made accordingly, and the face of the coupling piece facing the bobbin head must be provided with bevels or a rounding so that the coupling piece can recede into its guide in the driving in and out of the weft bobbin.

It is also possible furthermore to form the coupling head 15 not for engagement in the bobbin head but for shape-locking grasping around the latter.

I claim:

1. In an automatic weaving shuttle having a body formed with a recess for receiving a bobbin, the provision of piercings in the body and extending into said recess, a substantially U-shaped bobbin retaining insert located by frictional engagement in said recess and having anchoring pegs corresponding to and engaging the piercings also to retain the insert within the recess, said insert being formed with two legs and a crosspiece connecting said legs, sliding guides formed in said legs and arranged in pairs on both sides of the central longitudinal plane of the bobbin. Bobbin retaining dogs movable within said sliding guides, helical springs urging the dogs into engagement with the bobbin for retaining the bobbin in the recess, a projection on the crosspiece, a spigot slidably mounted in the projection and extending through the crosspiece and a helical spring arranged within the projection to urge the spigot into engagement with the bobbin for centering the bobbin within the recess.

2. A shuttle according to claim 1, in which the dogs are provided with stops for the limitation of the stroke of the dogs when the bobbin is removed.

3. A shuttle according to claim 1, in which the spigot has a forward part in the shape of a cross which extends through a cruciform piercing in the crosspiece.

4. An automatic weaving shuttle, having a body formed with a recess, in combination with a bobbin having a cylindrical neck and a cylindrical head of larger diameter than the neck, wherein there are provided piercings in the body and extending into said recess, a substantially U-shaped bobbin retaining insert located by frictional engagement in said recess and having anchoring pegs corresponding to and engaging the piercings also to retain the insert within the recess, said insert being formed with two legs and a crosspiece connecting said legs, sliding guides formed in said legs in the ends thereof remote from the crosspiece and arranged in pairs on both sides of the central longitudinal plane of the bobbin. Bobbin retaining dogs movable within said sliding guides, helical springs urging the dogs into engagement with the neck of the bobbin for retaining the bobbin in the recess, a projection on the crosspiece, a spigot slidably mounted in the projection and extending through the crosspiece and a helical spring arranged within the projection to urge the spigot into engagement with a recess in the head of the bobbin for centering the bobbin within the recess.

5. A combination according to claim 4 in which the spigot has a forward part in the shape of a cross which extends through a cruciform piercing in the crosspiece and engages a correspondingly shaped cruciform recess in the head of the bobbin.

* * * * *